US012669020B2

(12) United States Patent
Hassig Fonseca et al.

(10) Patent No.: US 12,669,020 B2
(45) Date of Patent: Jun. 30, 2026

(54) COILED TUBING SYSTEMS AND METHODS FOR GEOTHERMAL WELLS

(71) Applicant: Schlumberger Technology Corporation, Sugar Land, TX (US)

(72) Inventors: Santiago Hassig Fonseca, Luanda (AO); Abdul Muqtadir Khan, Sugar Land, TX (US); Ashley Bernard Johnson, Cambridge (GB); Ryan Loundy, Sugar Land, TX (US); Mark Callister Oettli, Sugar Land, TX (US); Benoit Deville, Sugar Land, TX (US); David Box, Sugar Land, TX (US); Andrew Markham, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/223,345

(22) Filed: May 30, 2025

(65) Prior Publication Data

US 2025/0290377 A1 Sep. 18, 2025

Related U.S. Application Data

(63) Continuation-in-part of application No. 18/678,911, filed on May 30, 2024, which is a continuation-in-part
(Continued)

(51) Int. Cl.
*E21B 17/20* (2006.01)
*E21B 19/22* (2006.01)
(Continued)

(52) U.S. Cl.
CPC ..... *E21B 17/20* (2013.01); *E21B 43/114* (2013.01); *E21B 47/04* (2013.01); *E21B 19/22* (2013.01); *F24T 50/00* (2018.05)

(58) Field of Classification Search
CPC ..... E21B 17/20; E21B 19/22; E21B 47/04
See application file for complete search history.

(56) References Cited

U.S. PATENT DOCUMENTS 2,896,718 A 7/1959 Kibby
3,642,068 A 2/1972 Fitch
(Continued)

FOREIGN PATENT DOCUMENTS

CN 105840146 A 8/2016
CN 108756843 A 11/2018
(Continued)

OTHER PUBLICATIONS

Al-Nakhli, A. R., "Chemically-Induced Pressure Pulse: A New Fracturing Technology for Unconventional Reservoirs", SPE-172551-MS, presented at the SPE Middle East Oil Gas Show and Conference, Manama, Bahrain, 2015.

*Primary Examiner* — Kenneth L Thompson
(74) *Attorney, Agent, or Firm* — Kyle R. Miiller

(57) ABSTRACT

A coiled tubing system includes a coiled tubing string configured to couple to a downhole tool to move the downhole tool along a geothermal well, an injector head configured to control movement of the coiled tubing string and the downhole tool along the geothermal well, one or more sensors configured to capture sensor data indicative of a distance traveled by the coiled tubing string along the geothermal well, and a controller configured to control operation of the injector head to move the coiled tubing string and the downhole tool to a measured depth within the geothermal well that corresponds to an intersection of a feature with the geothermal well based on the sensor data received from the one or more sensors.

13 Claims, 4 Drawing Sheets

Related U.S. Application Data of application No. 18/479,187, filed on Oct. 2, 2023, now Pat. No. 12,449,163.

(60) Provisional application No. 63/504,797, filed on May 30, 2023.

(51) Int. Cl.

| | |
|---|---|
| ***E21B 43/114*** | (2006.01) |
| ***E21B 47/04*** | (2012.01) |
| *F24T 50/00* | (2018.01) |

(56) References Cited

U.S. PATENT DOCUMENTS

| | | | | |
|---|---|---|---|---|
| 3,878,884 | A | 4/1975 | Raleigh | |
| 3,918,524 | A | 11/1975 | Broaddus | |
| 4,047,569 | A | 9/1977 | Tagirov | |
| 4,223,729 | A | 9/1980 | Foster | |
| 5,785,133 | A | 7/1998 | Murray | |
| 6,305,467 | B1 * | 10/2001 | Connell | E21B 23/042 73/152.01 |
| 6,644,407 | B2 | 11/2003 | Arnold, III | |
| 7,828,063 | B2 | 11/2010 | Olsen | |
| 8,685,187 | B2 | 4/2014 | Han | |
| 8,820,075 | B2 | 9/2014 | Kaminsky | |
| 9,217,321 | B2 * | 12/2015 | Marvel | E21B 47/04 |
| 9,726,157 | B2 | 8/2017 | Sweatman | |
| 10,260,778 | B2 | 4/2019 | Sønju | |
| 10,551,091 | B2 | 2/2020 | Kruger | |
| 10,753,163 | B2 * | 8/2020 | Dobkins | E21B 17/20 |
| 11,220,882 | B2 | 1/2022 | Nevison | |
| 11,434,740 | B1 | 9/2022 | Ngyuen | |
| 11,473,410 | B1 | 10/2022 | Batarseh | |
| 11,566,479 | B1 * | 1/2023 | Ogundare | E21B 19/22 |
| 11,795,365 | B1 | 10/2023 | Nguyen | |
| 11,808,121 | B2 | 11/2023 | Norbeck | |
| 11,959,666 | B2 | 4/2024 | Fleckenstein | |
| 11,976,236 | B2 | 5/2024 | Evans | |
| 12,104,828 | B2 | 10/2024 | Geiser | |
| 12,258,945 | B2 | 3/2025 | Messner | |
| 12,292,212 | B2 | 5/2025 | Barree | |
| 12,298,043 | B1 * | 5/2025 | Livescu | E21B 17/20 |
| 12,305,893 | B1 | 5/2025 | Alcantar | |
| 2003/0209346 | A1 * | 11/2003 | Austbo | B65G 23/14 166/77.2 |
| 2004/0040707 | A1 * | 3/2004 | Dusterhoft | E21B 33/124 166/279 |
| 2006/0102343 | A1 | 5/2006 | Skinner | |
| 2009/0242198 | A1 | 10/2009 | Evans | |
| 2010/0032156 | A1 | 2/2010 | Petty | |
| 2010/0294494 | A1 | 11/2010 | Hefley | |
| 2010/0307756 | A1 | 12/2010 | Jung | |
| 2011/0234421 | A1 | 9/2011 | Smith | |
| 2013/0292177 | A1 | 11/2013 | Meurer | |
| 2014/0262256 | A1 | 9/2014 | Zemach | |
| 2015/0204174 | A1 | 7/2015 | Kresse | |
| 2015/0233218 | A1 | 8/2015 | Myhre | |
| 2015/0275638 | A1 | 10/2015 | Wang | |
| 2015/0300327 | A1 | 10/2015 | Sweatman | |
| 2017/0321934 | A1 | 11/2017 | Kruger | |
| 2018/0016895 | A1 | 1/2018 | Weng | |
| 2018/0080309 | A1 | 3/2018 | Althoff | |
| 2018/0202266 | A1 | 7/2018 | Holland | |
| 2018/0266225 | A1 | 9/2018 | Kemick | |
| 2019/0316455 | A1 | 10/2019 | Surjaatmadja | |
| 2020/0217181 | A1 | 7/2020 | Norbeck | |
| 2020/0277528 | A1 | 9/2020 | Taylor | |
| 2021/0363866 | A1 | 11/2021 | Al-Nakhli | |
| 2022/0325920 | A1 | 10/2022 | Barral | |
| 2023/0045716 | A1 | 2/2023 | Normann | |
| 2023/0064121 | A1 | 3/2023 | Xia | |
| 2023/0083056 | A1 | 3/2023 | Acuna Cespedes | |
| 2023/0288099 | A1 | 9/2023 | Toews | |
| 2024/0035710 | A1 | 2/2024 | Toews | |
| 2024/0069238 | A1 | 2/2024 | Arshad | |
| 2024/0167731 | A1 | 5/2024 | Liang | |
| 2024/0280295 | A1 | 8/2024 | Olorode | |
| 2024/0401445 | A1 | 12/2024 | Khan | |
| 2024/0401450 | A1 | 12/2024 | Johnson | |
| 2024/0401572 | A1 | 12/2024 | Khan | |
| 2024/0418412 | A1 | 12/2024 | Barree | |
| 2025/0020052 | A1 * | 1/2025 | Abuhaikal | E21B 47/09 |
| 2025/0109891 | A1 | 4/2025 | Johnson | |

FOREIGN PATENT DOCUMENTS

| | | | |
|---|---|---|---|
| CN | 111043780 | A | 4/2020 |
| CN | 111520924 | A | 8/2020 |
| CN | 112012709 | A | 12/2020 |
| CN | 213898935 | U | 8/2021 |
| CN | 113863914 | A | 12/2021 |
| CN | 120043261 | A | 5/2025 |
| JP | 2015121093 | A | 7/2015 |
| WO | 2021078766 | A1 | 4/2021 |
| WO | 2022055947 | A1 | 3/2022 |

* cited by examiner

COILED TUBING SYSTEMS AND METHODS FOR GEOTHERMAL WELLS

CROSS-REFERENCE TO RELATED APPLICATION(S)

This application claims priority from U.S. application Ser. No. 18/678,911 filed on May 30, 2024, which is a continuation-in-part of U.S. application Ser. No. 18/479,187 filed on Oct. 2, 2023 and claims priority to U.S. Provisional Appl. No. 63/504,797 filed on May 30, 2023, each of which are herein incorporated by reference in their entirety.

FIELD

The present disclosure relates to geothermal systems that extract thermal energy from a geothermal reservoir.

BACKGROUND

Geothermal systems that extract thermal energy (e.g., heat) from a geothermal reservoir are generating considerable interest. A conventional geothermal reservoir is a volume of subsurface rock that contains a natural source of pressurized geothermal fluid that is heated by natural geological processes below the Earth's surface. The pressurized geothermal fluid can include hot water or brine. The pressurized geothermal fluid is used as a source of thermal energy. A geothermal well is drilled from the surface into and through the conventional geothermal reservoir, and may intersect one or more naturally-occurring fractures in the subsurface rock of the conventional geothermal reservoir. These naturally-occurring fractures provide a flow path of the pressurized geothermal fluid into the geothermal well where it flows through the geothermal well to the surface. The thermal energy from the geothermal fluid that flows to the surface can be extracted and used by an energy conversion plant for power generation, large scale heating or cooling, industrial/agricultural processes, or other geothermal applications.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In an embodiment, a coiled tubing system includes a coiled tubing string configured to couple to a downhole tool to move the downhole tool along a geothermal well, an injector head configured to control movement of the coiled tubing string and the downhole tool along the geothermal well, one or more sensors configured to capture sensor data indicative of a distance traveled by the coiled tubing string along the geothermal well, and a controller configured to control operation of the injector head to move the coiled tubing string and the downhole tool to a measured depth within the geothermal well that corresponds to an intersection of a feature with the geothermal well based on the sensor data received from the one or more sensors.

In another embodiment, a dedicated brake system for a coiled tubing system includes an injector head configured to control movement of a coiled tubing string of the coiled tubing system along a geothermal well, wherein the injector head includes one or more chains configured to grip the coiled tubing string to move the coiled tubing string, a motor coupled to the one or more chains and configured to bias the one or more chains in a particular direction to move the coiled tubing string in the particular direction, a brake configured to engage the motor to stop the movement of the coiled tubing string, and one or more sensors configured to monitor a distance traveled by the coiled tubing string. The dedicated brake system further includes a controller configured to control operation of the injector head by receiving sensor data from the one or more sensors indicative of the distance traveled by the coiled tubing string, causing the motor to bias the one or more chains in the particular direction toward a measured depth corresponding to an intersection of a feature with the geothermal well, and causing the brake to engage the motor to stop the movement of the coiled tubing string in response to determining that the distance traveled corresponds to the measured depth.

In another embodiment, a method for locating a downhole tool in a geothermal well using a coiled tubing system includes analyzing subsurface data to determine respective locations of a plurality of features that intersect the geothermal well, operating, via a controller, an injector head of the coiled tubing system to deploy the downhole tool toward a first location of a first feature of the plurality of features, wherein the first location includes a measured depth along the geothermal well, receiving, via one or more sensors, sensor data indicative of a distance traveled by a coiled tubing string of the coiled tubing system coupled to the downhole tool, determining, via the controller, that the distance traveled by the coiled tubing string corresponds to the measured depth based on the sensor data, and causing, via the controller, the injector head to stop movement of the coiled tubing string in response to determining that the distance traveled by the coiled tubing string corresponds to the measured depth of the first feature.

BRIEF DESCRIPTION OF THE DRAWINGS

The subject disclosure is further described in the detailed description which follows, in reference to the noted plurality of drawings by way of non-limiting examples of the subject disclosure, in which like reference numerals represent similar parts throughout the several views of the drawings, and wherein.

DETAILED DESCRIPTION

Figure 1:
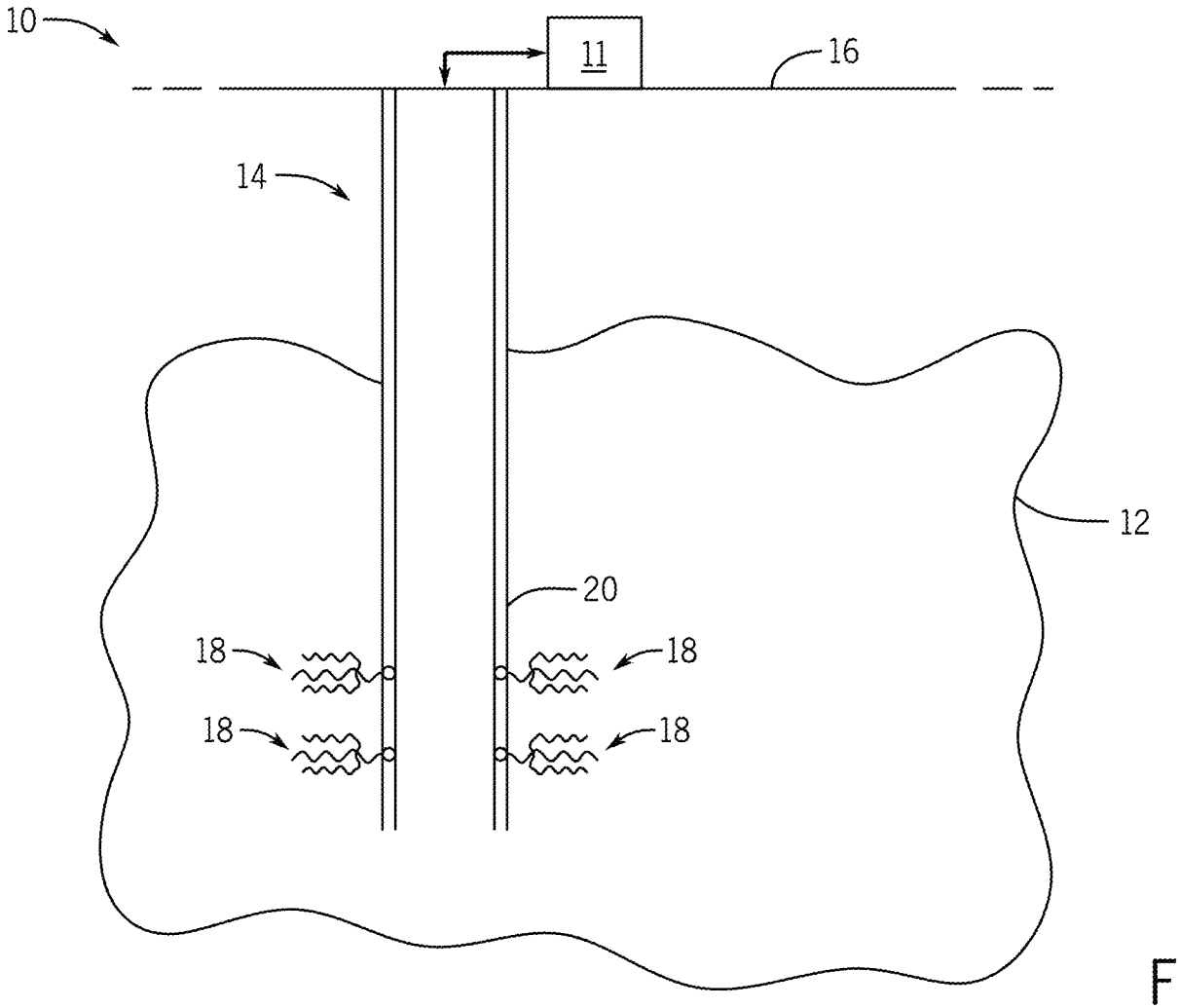
FIG. 1 is a schematic diagram of an embodiment of a geothermal system having a geothermal well that intersects and/or connects to one or more features extending through a geothermal reservoir, in accordance with aspects of the present disclosure.

The particulars shown herein are by way of example and for purposes of illustrative discussion of the embodiments of the subject disclosure only and are presented in the cause of providing what is believed to be the most useful and readily understood description of the principles and conceptual aspects of the subject disclosure. In this regard, no attempt is made to show structural details in more detail than is necessary for the fundamental understanding of the subject disclosure, the description taken with the drawings making apparent to those skilled in the art how the several forms of the subject disclosure may be embodied in practice. Furthermore, like reference numbers and designations in the various drawings indicate like elements.

As used herein, the term "near wellbore region" refers to a rock formation within less than 5 feet from a wellbore surface. That is, a geothermal wellbore having a 12-inch diameter includes a near wellbore region with an 11-foot diameter that is centered in the geothermal wellbore.

As used herein, the term "feature" refers to a portion of a rock formation within the near wellbore region that includes pressurized geothermal fluid that may be accessed by a geothermal wellbore.

As used herein, the term "aperture" refers to an opening or space in the near wellbore region that connects a feature to a geothermal well at the intersection of the feature and the geothermal well.

As used herein, the term "fracture" refers to a feature within the near wellbore region that is in fluid communication with the geothermal well via one or more apertures.

As used herein, the term "opening a feature" means enhancing or increasing flow of geothermal fluid carried by a feature into a geothermal well by enlarging an aperture that connects the feature to the geothermal well or opening new flow channels that are fluidly connected to the feature or unblocking or improving the flow of geothermal fluid through an aperture that connects the feature to the geothermal well.

As used herein, the term "near the intersection of the feature" means within less than 30 feet of a center of the intersection of the feature with the geothermal well.

Geothermal reservoirs contain a natural source of pressurized geothermal fluid (e.g., hot water, brine, steam) that may be utilized as a source of thermal energy. For example, one or more geothermal wells may be drilled from the surface into and through the geothermal reservoir, and the geothermal wells may intersect one or more features in the subsurface rock of the geothermal reservoir. In certain instances, these features may naturally provide a flow path for the pressurized geothermal fluid into the geothermal well(s), thereby enabling the pressurized geothermal fluid to be directed to the surface via the geothermal well(s). For example, the features may correspond to fractures (e.g., natural fractures) within the subsurface rock that are in fluid communication with the geothermal well(s) via one or more apertures positioned at an intersection between the fracture and the geothermal well(s). In certain embodiments, the geothermal reservoirs are distinguished from and/or exclude hydrocarbon reservoirs (e.g., oil and natural gas reservoirs), and may exist in geological formations different from those containing hydrocarbon reservoirs. The thermal energy from the pressurized geothermal fluid (e.g., hot fluid) that flows to the surface via the geothermal well(s) may be extracted and used by an energy conversion plant for power generation, large scale heating and cooling, industrial and/or agricultural processes, or other geothermal applications.

Flow losses may occur where the feature(s) intersect and fluidly couple to the geothermal well(s) of the system. For example, the aperture of a feature at the intersection of the geothermal well can act as a flow restrictor that limits fluid flow through the feature and into the geothermal well. This can limit the amount of heat captured by the system and delivered to the surface and thus decrease the productivity of the system. In certain cases, an intervention may be performed to increase, enhance, and/or boost the flow of pressurized geothermal fluid into the geothermal well. For example, a coiled tubing system may be used to deploy a measurement tool into the geothermal well, where the measurement tool is configured to determine a measured depth of a feature that intersects the geothermal well. Thereafter, the coiled tubing system may deploy a downhole tool for an intervention at or near the intersection of the feature within an accuracy tolerance (e.g., within a threshold distance) of the measured depth. The positioning of the downhole tool at or near the feature (e.g., within the accuracy tolerance) may be important to improve the efficiency and/or efficacy of the intervention performed by the downhole tool.

Traditional coiled tubing systems may include an injector head configured to deploy (e.g., inject) and retract (e.g., retrieve) a coiled tubing string coupled to a downhole tool, thereby enabling movement of the downhole tool through a geothermal well. The injector head may include one or more chains that engage (e.g., grip) the coiled tubing string and a motor configured to drive the one or more chains. Operation of the injector head (e.g., operation of the motor and chains, movement of the coiled tubing string) may be controlled by an operator positioned within a control cabin of the coiled tubing system. For example, the control cabin may include control componentry communicatively coupled (e.g., hydraulicly coupled) to the injector head, thereby enabling the operator to control operation of the injector head (e.g., via a joystick) based on various detected data (e.g., depth and/or speed of coiled tubing string, weight measurements, circulating and wellhead pressures, chain tensioner pressures, blowout preventer [BOP] pressures, etc.).

Upon determining that a downhole tool coupled to the coiled tubing string has reached a measured depth corresponding to an intersection of a feature, the operator may operate the injector head to stop movement of the coiled tubing string. For example, the operator may send a control signal (e.g., hydraulic signal) along a control line (e.g., hydraulic line) from the control cabin to the injector head (e.g., by allowing the joystick to return to a resting or disengaged position, by providing a manual input to a brake button position within the control cabin), thereby causing a brake positioned on the injector head to engage the motor to stop movement of the coiled tubing string. Additionally, or alternatively, traditional coiled tubing systems may include an emergency brake system that operates as a fail-safe feature to mitigate against certain contingencies (e.g., tubing runaways, weight deviations indicative of a fault in the system). The emergency brake system may be positioned proximate the control cabin, and when detected parameters exceed one or more thresholds (e.g., contingency thresholds), the emergency brake system may send a control signal (e.g., a hydraulic signal) along a control line (e.g., hydraulic line) from the control cabin to the injector head, thereby causing the brake to engage the motor.

Unfortunately, various delays and/or latencies may be associated with the communication of the control signal from the operator (e.g., control cabin) and/or the emergency brake system to the brake positioned on the injector head, thereby limiting an ability of the coiled tubing system to granularly control movement (e.g., deployment, retraction) of a downhole tool coupled to the coiled tubing string. For example, the control line from the control cabin to the injector head (e.g., brake) and/or the control line from the emergency brake system to the injector head (e.g., brake) may include a series of conduits and valves and/or a hose extending a threshold distance from the control cabin (or emergency brake system) to the injector head. Traversal of the control signal through the series of conduits, valves, and/or hose may take a threshold amount of time (e.g., one second, two seconds), and thus, may be associated with a delay or latency. The delay or latency may be dependent upon a length of the conduits, a number of bends or turns associated with the conduits, frictional forces within the conduits, a pressure differential that must be overcome to enable the control signal to pass through the valves, a length of the hose, a number of turns or bends in hose, frictional forces within the control line, and the like. For example, as the control signal travels along the control line (e.g., through the conduits, valves, and/or hose), the control signal may change directions and/or experience various forces (e.g., frictional forces) that impede the movement of the control signal along the control line (e.g., decrease a velocity of the control signal from the control cabin and/or emergency brake system to the injector head), thereby causing latencies and/or delays associated with the communication of the control signal to the brake.

Moreover, traditional coiled tubing systems may be associated with additional delays and/or latencies related to the engagement of the brake with the motor of the injector head (e.g., upon receiving the control signal from the control cabin or emergency brake system). For example, the brake may correspond to a hydraulic brake that uses hydraulic pressure (e.g., hydraulic fluid) to maintain the brake in a disengaged position in which the motor is free to drive operation of the injector head. Upon receiving the control signal to engage the brake, the brake may be configured to drain or discharge the hydraulic fluid, thereby enabling the brake to transition to an engaged position in which movement of the motor is blocked via the brake. For example, the brake may discharge the hydraulic fluid along a discharge line (e.g., drain line) to a case drain, which may be located a threshold distance away from the brake and/or injector head. In traditional coiled tubing systems, the case drain may be coupled to other components of the coiled tubing system such that a pressure within the case drain fluctuates. In certain instances, the pressure within the case drain (e.g., based on other components discharging fluid into the case drain) may be greater than a threshold pressure such that a pressure differential between the brake and the case drain is insufficient to drive the hydraulic fluid from the brake to the case drain within a threshold amount of time. Thus, traversal of the hydraulic fluid along the discharge line may take an additional threshold amount of time, and thus, may be associated with an additional delay or latency. The additional delay or latency may be dependent upon a length of the discharge line, bends or turns in the discharge line, frictional forces associated with the discharge line, a pressure of the case drain, and the like.

Further still, traditional coiled tubing systems may utilize static or steady state models to position a downhole tool at or near a feature. However, such static or steady state models may not take into account various downhole factors (e.g., dynamic downhole factors, transient downhole factors) including tubing elongation (e.g., from coiled tubing plasticity) and/or readjustment (e.g., as a function of changing normal forces) associated with the coiled tubing string that occurs as the downhole tool is being moved (e.g., deployed, retracted). As such, traditional coiled tubing systems may be susceptible to downhole tool placement that is outside of and/or approaching an upper limit of the accuracy tolerance, which may decrease the efficacy of an intervention. Additionally, the static or steady state models may not take into account the rate of degradation of certain downhole tools and/or components thereof as a function of real-time conditions (e.g., pump rate, treatment or injection fluid, etc.) during an intervention. For example, abrasive perforating guns (APGs) may be used to enhance features of a geothermal reservoir (e.g., increase a degree of opening of the features, decrease flow losses associated with a feature). The APGs may include nozzles that inject and/or introduce a treatment fluid (e.g., slurry, proppant slurry) into the features to stimulate, open, and/or otherwise enhance the features (e.g., increase a permeability of the features), thereby increasing a flow rate of pressurized geothermal fluid from the features into the geothermal well. During operation, the nozzles may erode and/or degrade based on various downhole and/or operating conditions (e.g., pump rate, type of treatment fluid directed through the nozzles). Unfortunately, traditional systems may not account for the rate of erosion or degradation of the nozzles as a function of the downhole and/or operating conditions. That is, traditional systems may not compensate for gradual erosion of downhole tools and/or components thereof (e.g., nozzles of an APG), thereby limiting the efficiency of the downhole tools and reducing a quality or efficacy of an intervention (e.g., perforation) performed by the downhole tool.

The above-described shortcomings (e.g., latencies, delays, utilization of static or steady state models) may limit an ability of traditional coiled tubing systems to accurately position a downhole tool at the intersection of a target feature and the geothermal well (e.g., position a downhole tool within a threshold distance of a feature, position a downhole tool within the accuracy tolerance), thereby limiting an efficacy of an intervention performed by the downhole tool. That is, traditional coiled tubing systems may be associated with decreased resolution and/or inaccurate downhole tool placement (e.g., downhole tool placement outside of the accuracy tolerance). As discussed herein, a resolution of a coiled tubing system may refer to a minimum threshold distance that a coiled tubing system is capable of moving a downhole tool to perform an intervention. Thus, increasing a resolution of the coiled tubing system may enable the coiled tubing system to move with greater granularity by decreasing the minimum threshold distance that the coiled tubing system is capable of moving. Thus, it is now recognized that improved coiled tubing systems for modeling and positioning downhole tools with greater resolution and precision are desired.

Accordingly, present embodiments are directed toward coiled tubing systems that are arranged and/or configured in a manner that reduces the latencies and/or delays associated with the communication of a control signal to a brake disposed on an injector head and/or reduces the latencies and/or delays associated with discharging hydraulic fluid from a brake to enable the brake to engage the motor. For example, present embodiments may include components (e.g., dedicated components) configured and/or arranged in a manner that enables the coiled tubing system to respond to a control signal (e.g., brake signal) in a more efficient manner relative to traditional coiled tubing systems, thereby increasing a resolution of the coiled tubing system. In this way, the coiled tubing systems discussed herein may more precisely control the movement and/or positioning of a downhole tool at the intersection of a feature and a geological well (e.g., may control movement of the downhole tool with greater granularity), thereby improving the efficacy of an intervention performed by the downhole tool. As an example, present embodiments may include a measuring device (e.g., encoder) positioned on the injector head and configured to measure a distance traveled by the coiled tubing string and/or a rate at which the coiled tubing string is moved. The encoder may be configured to communicate with a brake system (e.g., dedicated brake system) of the coiled tubing system, thereby enabling the brake system (e.g., a controller of the brake system) to control operation of the brake based on certain detected parameters (e.g., based on the coiled tubing moving a threshold or desired distance as detected by the encoder). In this way, the brake system may enable more precise control of the movement of a coiled tubing string of the coiled tubing system, and thus, the positioning of a downhole tool coupled to the coiled tubing string.

The dedicated brake system may be positioned on the injector head and/or less than a threshold distance away from the injector head. By positioning the dedicated brake system on the injector head and/or less than a threshold distance away from the injector head, the distance the control signal must travel from the encoder to the brake system may be decreased, thereby decreasing delays and/or latencies associated with the communication of the control signal. For example, because the control signal travels shorter distances, the control signal may experience fewer forces (e.g., frictional forces) that impede the movement of the control signal toward the brake system. Additionally, in certain embodiments, the dedicated brake system may include a dedicated case drain configured to receive the hydraulic fluid from the brake once the brake transitions to the engaged position (e.g., upon receiving the control signal from the encoder). The dedicated case drain may also be positioned less than a threshold distance away from the injector head. Similar to the discussion above, by positioning the dedicated case drain less than a threshold distance away from the injector head, the distance the hydraulic fluid must travel from the brake to the case drain may be decreased, thereby decreasing delays and/or latencies associated with the draining of the hydraulic fluid.

In certain embodiments, the dedicated case drain may not be coupled to other components of the coiled tubing system, thereby enabling a pressure of the dedicated case drain to be maintained at a desired pressure. For example, by employing a dedicated case drain that is not coupled to other components of the coiled tubing system, pressure fluctuations within the case drain may be reduced such that a sufficient pressure differential is provided between the brake and the dedicated case drain to drive the hydraulic fluid out of the brake and into the case drain. In this way, additional delays and/or latencies associated with the draining of the hydraulic fluid from the brake may be reduced, thereby further improving the resolution and/or control of the movement of the coiled tubing (e.g., further improving an ability of the coiled tubing system to respond to a control signal to engage the brake in less than a threshold amount of time). In turn, a downhole tool coupled to the coiled tubing may be located within a geothermal well with greater accuracy and/or precision, thereby improving an efficacy of an intervention performed by the downhole tool.

Additionally, present embodiments are directed toward coiled tubing systems that utilize transient modeling to position downhole tools within a geothermal reservoir (e.g., within a geothermal well). For example, present embodiments may employ dynamic modeling systems configured to account for various downhole factors (e.g., real-time factors or conditions) associated with movement (e.g., deploying, retracting) of a downhole tool and/or operation of a downhole tool (e.g., perforation using abrasive perforating guns [APGs]). That is, the dynamic or transient modeling systems discussed herein may be configured to predict the effects of various downhole conditions on a coiled tubing string of a coiled tubing system, thereby improving the placement accuracy of a downhole tool coupled to the coiled tubing system. For example, the dynamic or transient models discussed herein may predict elongation and/or retraction of a coiled tube of the coiled tubing system and/or readjustment of the coiled tubing string based on the fluid being directed through the coiled tubing system (e.g., rate of fluid), the engagement of the coiled tubing string with the wellbore (e.g., frictional forces imparted to the coiled tube as the coiled tube traverses into and/or out of the wellbore), and the like. Additionally, the dynamic or transient models discussed herein may be configured to monitor and/or predict a rate of erosion of one or more components of the coiled tubing system (e.g., a nozzle of an APG coupled to the coiled tubing system) such that adjustments may be made to improve interventions (e.g., perforations) and/or contact with features that intersect the wellbore. For example, upon determining that a particular component is approaching a degradation threshold, a pump rate through the component may be adjusted (e.g., increased) to compensate for the erosion of the component, thereby maintaining desired jetting conditions while increasing a quality of the intervention (e.g., a quality of the perforation). In this way, present embodiments may account for dynamic changes that occur as the coiled tubing string is deployed into the wellbore and/or as the downhole tool is operated, thereby enabling increased placement accuracy (e.g., placement within an accuracy tolerance) of a downhole tool at or near a feature that intersects the wellbore.

With the preceding in mind, FIG. 1 is a schematic view of an embodiment of a geothermal system 10. The geothermal system 10 may include various components configured to access thermal energy from a geothermal reservoir 12 of the geothermal system 10, which may correspond to a volume of subsurface rock that contains a natural source of pressurized geothermal fluid (e.g., hot water, brine, steam). For example, the geothermal system 10 may include a well 14 (e.g., geothermal well, production well, producer well, injection well, injector well) drilled from the surface 16 into and through the geothermal reservoir 12, where the geothermal well 14 intersects one or more features 18 in the subsurface rock of the geothermal reservoir 12. In certain embodiments, the geothermal reservoir 12 is formed in the subsurface rock in an area generally excluding or with insubstantial amounts of hydrocarbons (e.g., oil and natural gas), wherein the subsurface rock may have characteristics substantially different from subsurface rock associated with a hydrocarbon reservoir. Each of the one or more features 18 may contain pressurized geothermal fluid, and the geothermal system 10 may be configured to provide a fluid flow path from each of the one or more features 18 into the geothermal well 14, thereby enabling the pressurized geothermal fluid to be directed along the fluid flow path, into the geothermal well 14, and toward the surface 16. Indeed, because the geothermal well 14 is drilled through a geothermal reservoir 12 generally excluding or with insubstantial amounts of hydrocarbons, the geothermal well 14 may not retrieve hydrocarbons, and instead may retrieve pressurized geothermal fluid from the geothermal reservoir 12. Thus, in certain embodiments, the geothermal well 14 may correspond to a production well configured to retrieve pressurized geothermal fluid from the geothermal reservoir 12. The thermal energy from the geothermal fluid that flows to the surface 16 may be extracted and used by an energy conversion system 11 (e.g., energy conversion plant) for power generation, large scale heating and cooling, industrial and/or agricultural processes, or other geothermal applications. For example, the energy conversion system 11 may include a steam turbine driven by the pressurized geothermal fluid, wherein the steam turbine drives an electrical generator.

Additionally, or alternatively, the geothermal reservoir 12 may be used as a heat exchanger to transfer heat to a fluid (e.g., thermal energy-depleted fluid, cold water) introduced into the geothermal reservoir 12 (e.g., into features 18 of the geothermal reservoir 12). That is, that natural properties of the geothermal reservoir 12 (e.g., temperature, pressure) and/or the natural properties of the pressurized geothermal fluid within the geothermal reservoir 12 may enable one or more of the features 18 to facilitate heat transfer between the geothermal reservoir 12 and a thermal fluid introduced into the geothermal reservoir 12. For example, in certain embodiments, the geothermal system 10 may correspond to and/or be arranged in a huff and puff configuration. In such embodiments, the energy conversion system 11 may be configured to direct (e.g., pump) a thermal energy-depleted fluid (e.g., cold water) along an injection line 13 (e.g., injection conduit) under pressure into the geothermal well 14, thereby enabling the thermal energy-depleted fluid to flow into one or more of the features 18 (e.g., during an inflation phase). The geothermal well 14 may then be sealed or closed off (e.g., via a valve disposed along the injection line 13) for a threshold amount of time, thereby enabling the geothermal reservoir 12 to pressurize and/or increase the temperature of the thermal energy-depleted fluid disposed within the features 18 of the geothermal reservoir 12. For example, natural properties of the geothermal reservoir 12 (e.g., temperature and/or pressure of the subsurface rock) may be greater than the operating properties of the thermal energy-depleted fluid (e.g., temperature and pressure of the thermal energy-depleted fluid). Additionally, or alternatively, a temperature of the pressurized geothermal fluid within the subsurface rock (e.g., within the features 18) of the geothermal reservoir 12 may be greater than a temperature of the thermal energy-depleted fluid introduced into the geothermal reservoir 12 during the injection phase. As such, the geothermal reservoir 12 may function as a heat exchanger in which the warmer subsurface rock and/or pressurized geothermal fluid deposits heat to the cooler thermal energy-depleted fluid, thereby increasing the temperature of the thermal energy-depleted fluid.

As the temperature of the thermal energy-depleted fluid increases, the thermal energy-depleted fluid may transition to a thermal energy-charged fluid, which may be retrieved by the energy conversion system 11. For example, upon opening the geothermal well 14 (e.g., transitioning the valve from a closed position to an open position, during a deflation phase), the natural properties of the geothermal reservoir 12 may generate a pressure differential between the geothermal reservoir 12 and the surface 16, thereby enabling the geothermal reservoir 12 to drive the thermal energy-charged fluid toward the surface 16. That is, the subsurface rock may have a natural tendency to migrate back to an deflated position (e.g., due to the increased pressures associated with a geothermal reservoir 12), such that thermal energy-depleted fluid introduced into the one or more features 18 during an inflation phase is discharged out of the one or more features 18 as thermal energy-charged fluid 18 during a deflation phase. The thermal energy-charged fluid may be directed out of the geothermal well 14 and along an extraction line 15 to the energy conversion system 11 to be used for energy conversion, as discussed above. Thus, in certain embodiments, the geothermal well 14 may correspond to an injector well (e.g., during an injection phase) and may correspond to a producer well (e.g., during a deflation phase). It should be appreciated that, in certain embodiments, a single line (e.g., injection line 13) may be used as both the injection line 13 and the control line 15.

Further, it should be appreciated that in certain embodiments, the geothermal system 10 may correspond to and/or be arranged in an injector/producer well configuration in which multiple geothermal wells 14 are employed to leverage the heat exchange capabilities of the geothermal reservoir 12. For example, in certain embodiments, the geothermal system 10 may include a first geothermal well 14 that corresponds to an injector well (e.g., injection well) and a second geothermal well 14 that corresponds to a producer well (e.g., production well). Similar to the discussion above with respect to a huff and puff configuration, the injector well may be configured to direct thermal-energy depleted fluid under pressure into the geothermal reservoir 12, such that the thermal-energy depleted fluid flows into one or more of the features 18. As the thermal-energy depleted fluid is directed into the geothermal reservoir 12, the geothermal reservoir 12 may pressurize and/or increase the temperature of the thermal-energy depleted fluid, thereby causing the thermal-energy depleted fluid to transition to a thermal-energy charged fluid. Thereafter, the producer well may retrieve the thermal-energy charged fluid and direct the thermal-energy charged fluid toward the energy conversion plant 11.

In the illustrated embodiment, the wellbore of the geothermal well 14 is completed with a perforated liner 20 (e.g., slotted liner) with perforations in the intervals of the geothermal well 14 that intersect the features 18. In alternative embodiments, the wellbore of the geothermal well 14 may be completed with a perforated casing or as an open wellbore.

In certain embodiments, a downhole tool may be deployed into the geothermal well 14 and the downhole tool may be operated to perform one or more interventions that open the one or more features 18 (e.g., increase the permeability of the one or more features 18, enlarge one or more of the features 18, enlarge an aperture of a feature) or otherwise enhance and/or increase the flow rate of pressurized geothermal fluid into the geothermal well 14 of the geothermal system 10. For example, in certain embodiments, the intervention process may include the use of abrasive perforated guns (APGs) which are configured to perforate the geothermal reservoir 12 (e.g., perforate features 18 of the geothermal reservoir 12) by discharging a fluid (e.g., injection fluid, slurry) at or near a feature 18 to enhance the feature 18 (e.g., increase a size of the feature 18, increase a size of an aperture fluidly coupling the feature 18 to the geothermal well 14, increase the permeability of the feature 18), thereby increasing and/or boosting the flow of pressurized geothermal fluid from the feature 18 into the geothermal well 14. It should be appreciated that other interventions, such as acidizing, cutting, jetting, and the like, may be used to increase and/or boost the flow of pressurized geothermal fluid from the feature 18 into the geothermal well 14. Additionally, or alternatively, the interventions performed by the downhole tool may be configured to enhance and/or increase a heat transfer capacity of the geothermal reservoir 12 (e.g., by enlarging one or more of the features, by generating a fluid network within the geothermal reservoir 12).

Figure 2:
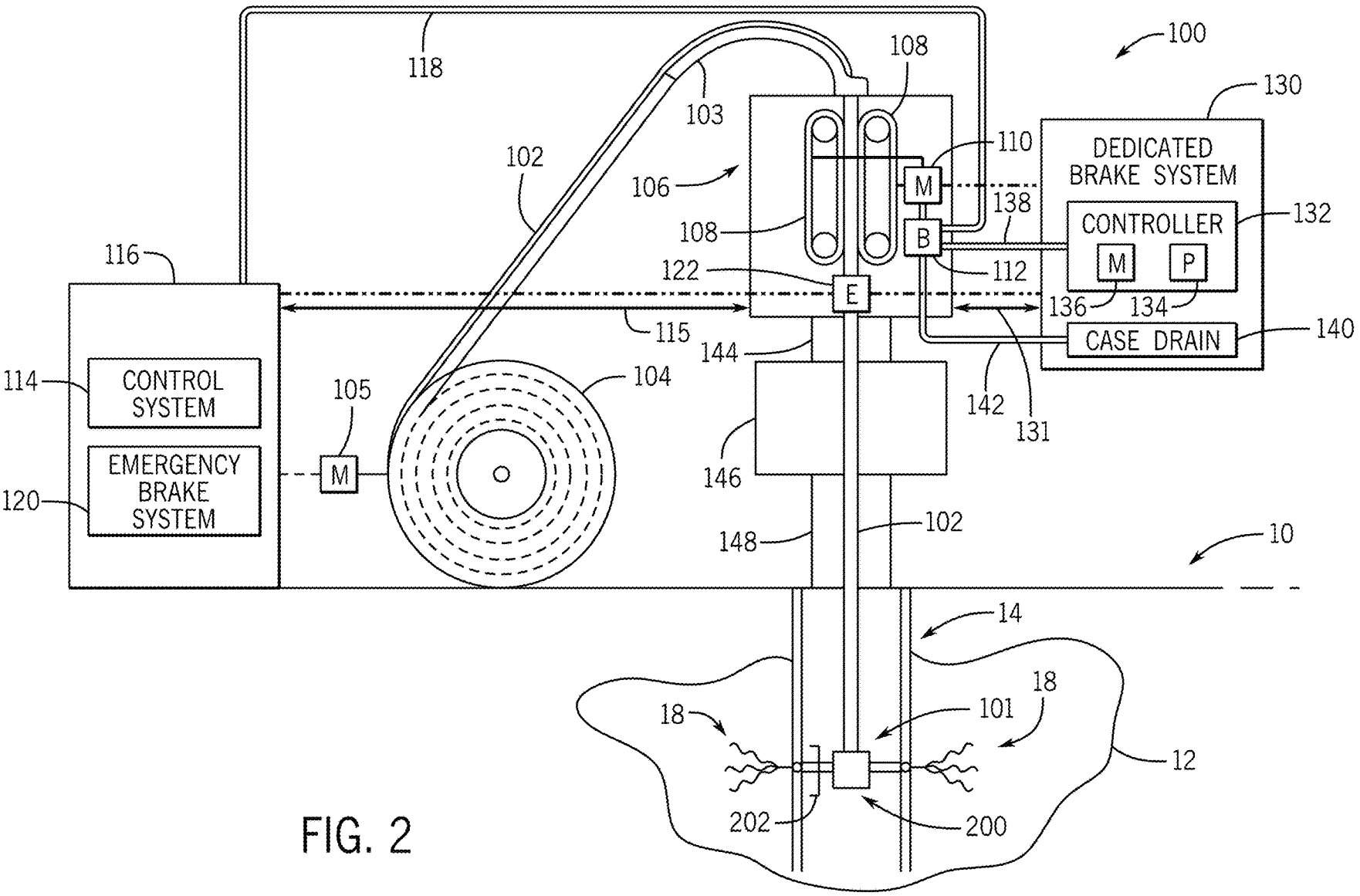
FIG. 2 is a schematic diagram of an embodiment of a coiled tubing system that may be used to control movement and/or operation of a downhole tool coupled to the coiled tubing system, in accordance with aspects of the present disclosure.

Accurate positioning of tools (e.g., downhole tools) within the geothermal well 14 at or near a feature 18 (e.g., within an accuracy tolerance, within a threshold distance of the feature 18) may be important to improve the efficiency and/or efficacy of the intervention used to enhance the feature 18. Accordingly, present embodiments may employ a coiled tubing system configured to position a downhole tool coupled to the coiled tubing system at a desired location (e.g., within a threshold distance from a feature). For example, FIG. 2 is a schematic embodiment of a coiled tubing system 100 (e.g., conveyance system) that may be used to control movement of a downhole tool 200 coupled to the coiled tubing system 100 within a geothermal well (e.g., production well, producer well, injection well, injector well), such as the geothermal well 14 of FIG. 1. The coiled tubing system 100 may be configured to enable precise control of the movement of the downhole tool 200 along the geothermal well 14, thereby enabling the downhole tool 200 to be placed within an accuracy tolerance 202 of (e.g., less than a threshold distance from) the one or more features 18 of the geothermal reservoir 12. That is, as discussed in greater detail below, the coiled tubing system 100 may enable the downhole tool 200 to be moved with greater precision and accuracy (e.g., increased granular control), thereby improving a resolution of the coiled tubing system 100. In this way, an efficiency and/or efficacy of an intervention performed by the downhole tool 200 may be improved.

In the illustrated embodiment, the coiled tubing system 100 includes a coiled tubing string 102 (e.g., coiled tubing) disposed about a reel 104 (e.g., arrangement, reel drum), where an end 101 (e.g., distal end) of the coiled tubing string 102 is configured to couple to the downhole tool 200 to drive movement of the downhole tool 200 along the geothermal well 14. The coiled tubing string 102 may extend from the reel 104 to an injector head 106 of the coiled tubing system, and may be supported by a support 103 (e.g., gooseneck) coupled to the injector head 106. In certain embodiments, the reel 104 may include a motor 105 configured to operate the reel 104 to maintain a desired tension within the coiled tubing string 102. Movement of the coiled tubing string 102, and thus, the downhole tool 200 coupled thereto, may be driven by the injector head 106 of the coiled tubing system 100. For example, the injector head 106 may include one or more chains 108 configured to engage with (e.g., grip) the coiled tubing string 102 to drive movement of the coiled tubing string 102 along the geothermal well 14. The operation of the chains 108 may be controlled by a motor 110 configured to drive the chains 108 in a particular direction to bias the coiled tubing string 102 in the particular direction. In certain embodiments, the motor 110 may include a brake 112 (e.g., hydraulic brake, clutch) disposed near the motor 110, and the brake 112 may be configured to engage the motor 110 to stop movement of the motor 110 (e.g., in response to receiving a control signal).

In certain embodiments, the brake 112 may correspond to a hydraulic brake configured to engage or disengage the motor based on various control signals. For example, when the brake is in an active state (e.g., when hydraulic fluid is directed toward the brake 112), the brake 112 may be configured to disengage from the motor 110, thereby enabling the motor 110 to drive movement of the chains 108 of the injector head 106. For example, the brake 112 may be spring loaded such that when hydraulic fluid is not directed toward the brake 112 (e.g., during a resting state of the brake 112), the spring may bias the brake 112 into engagement with the motor 110, thereby limiting movement of the motor 110, and thus, the chains 108. Conversely, when a hydraulic fluid is directed into the brake 112 (e.g., during an active state of the brake 112), the hydraulic fluid may overcome the force of the spring such that the brake 112 disengages from the motor 110, thereby enabling the motor 110 to drive movement of the chains 108, and thus, movement of the downhole tool 200.

In certain embodiments, operation of the motor 110 and/or brake 112, and thus the movement of the coiled tubing string 102 via the chains 108, may be controlled by a control system 114 positioned within a control cabin 116 of the coiled tubing system 100. The control cabin 116 may be positioned a threshold distance 115 (e.g., ten meters, twenty meters, thirty meters, or more) from the injector head 106. For example, an operator positioned within the control cabin 116 may utilize control componentry of the control system 114 (e.g., a joystick) to cause the motor 110 to drive the chains 108 in a particular direction. Additionally, or alternatively, the control componentry of the control system 114 may enable the operator to provide a manual input to engage the brake 112 of the coiled tubing system 100, thereby stopping movement of the motor 110. That is, the control system 114 of the control cabin 116 may be configured to send one or more control signals (e.g., hydraulic signals) along a control line 118 (e.g., hydraulic line) to the motor 110 and/or brake 112 based on one or more inputs provided by an operator positioned within the control cabin 116, thereby enabling the downhole tool 200 coupled to the coiled tubing string 102 to be moved and/or stopped within the geothermal well 14. The control system 114 may also be communicatively coupled to the motor 105 to control operation of the reel 104, thereby maintaining a desired tension within the coiled tubing string 102.

In certain embodiments, the control cabin 116 may also include an emergency brake system 120 configured to communicate with the brake 112, thereby enabling the brake 112 to engage the motor 110. For example, the emergency brake system 120 may correspond to a fail-safe system configured to mitigate against certain contingencies (e.g., tubing runaways, weight deviations indicative of a fault in the system 100, pressure fluctuations). When detected and/or measured parameters exceed one or more thresholds (e.g., contingency thresholds, pre-defined thresholds), the emergency brake system 120 may be configured to send a control signal (e.g., a hydraulic signal) along a control line (e.g., control line 118) from the control cabin 116 to the injector head 106, thereby causing the brake 112 to engage the motor 110. Notably, control signals sent from the control cabin 116 (e.g., from the control system 114 positioned within the control cabin) may travel the threshold distance 115 along the control line 118 before reaching the injector head 106.

As shown in the illustrated embodiment, the injector head 106 of the coiled tubing system 100 includes a sensor 122 (e.g., encoder, measurement device) configured to measure a distance that the coiled tubing string 102 has moved (e.g., distance traveled) within the geothermal well 14 and/or a rate at which the coiled tubing string 102 is moved. In certain embodiments, the encoder 122 may be sensitively tuned such that the encoder 122 is capable of detecting when the coiled tubing string 102 has been displaced a minimum threshold distance (e.g., one centimeter, five centimeters, ten centimeters). That is, granular movement (e.g., movement less than a threshold distance) of the coiled tubing string 102 may be monitored by the encoder 122, and such data may be communicated to the control system 114 of the control cabin 116. By communicating such data to the control cabin 116, an operator within the control cabin 116 may provide a manual input via the control componentry (e.g., a brake button) of the control system 114 to engage the brake 112 based on the data from the encoder 122 indicating that the coiled tubing string 102 has been displaced a desired distance. Additionally, or alternatively, the encoder 122 may be integrated with the emergency brake system 120, thereby enabling the emergency brake system 120 to automatically engage the brake 112 based on the data from the encoder 122 indicating that the coiled tubing string 102 has been displaced a desired distance. In certain embodiments, the desired distance may correspond to a measured depth of a feature that intersects the geothermal well. By providing data from the encoder 122 to an operator within the control cabin 116 and/or by integrating the encoder 122 with the emergency brake system 120, the coiled tubing system 100 may enable more precise control of the movement of the coiled tubing string 102, thereby increasing a resolution of the coiled tubing system 100.

In the illustrated embodiment, the coiled tubing system 100 also includes a dedicated brake system 130. In certain embodiments, the dedicated brake system 130 may be a component of the injector head 106 or may be communicatively coupled to the injector head 106 (e.g., communicatively coupled to the chains 108, motor 110, brake 112, measurement device 122). For example, the dedicated brake system 130 may be mounted on the injector head 106 and/or may be positioned less than a threshold distance 131 (e.g., ten meters, five meters, one meter) from the injector head 106. The dedicated brake system 130 may include a dedicated controller 132 (e.g., dedicated control system) configured to control (e.g., automatically control) operation of injector head 106 (e.g., the motor 110 and/or brake 112, and thus, the chains 108). For example, the dedicated controller 132 may include processing circuitry 134 and a memory 136 (e.g., memory device) configured to store instructions that, when executed by the processing circuitry 134, cause the processing circuitry 134 to send a control signal to the motor 110 to cause the motor 110 to bias the chains 108 in a particular direction, thereby enabling movement of the coiled tubing string 102 in the particular direction. Additionally, or alternatively, the dedicated controller 132 may be configured to send a control signal (e.g., hydraulic signal) along a control line 138 to engage the brake 112 to stop movement of the coiled tubing string 102 (e.g., based on various data).

In certain embodiments, the dedicated controller 132 may receive data (e.g., sensor data) from the encoder 122, thereby enabling the controller 132 to control operation of the motor 110 and/or brake 112 based on the data received from the encoder 122. For example, as noted above, the encoder 122 may be configured to monitor granular movement of the coiled tubing string 102. Thus, upon receiving data from the encoder 122 indicating that the coiled tubing string 102 has been displaced a desired distance, the controller 132 may send the control signal along the control line 138 to engage the brake 112. As noted above, in certain embodiments, the desired distance may correspond to a measured depth of a feature that intersects the geothermal well. Further, in certain embodiments, after placing the downhole tool 200 within the accuracy tolerance 202 of a first feature that intersects the geothermal well, the dedicated controller 132 may receive data (e.g., well log data) indicating that a measured depth of a second feature that intersects the geothermal well is a threshold distance from the first feature. Thus, in certain embodiments, the desired distance may correspond to a measured distance between two features that intersect the geothermal well.

As an example, a first feature that intersects the geothermal well may have a measured depth of 2500 meters from the surface and a second feature that intersects the geothermal well may have a measured depth of 2300 meters from the surface. Using data from the encoder 122, the dedicated controller 132 may be configured to control operation of the injector head 106 to deploy the downhole tool 200 to the measured depth of 2500 meters corresponding to the first feature. For example, upon reaching the measured depth of 2500 meters, the encoder 122 may communicate sensor data to the controller 132 indicating that the coiled tubing string 102 has been displaced a desired distance (i.e., 2500 meters), thereby enabling the controller 132 to send a control signal to the brake 112 to stop movement of the coiled tubing string 102. Thereafter (e.g., after performing an intervention at the first measured depth), the controller 132 may be configured to control operation of the injector head 106 to retract the downhole tool 200 to the measured depth of 2300 meters corresponding to the second feature. For example, while the coiled tubing string 102 is being retracted along the geothermal well, the encoder 122 may communicate sensor data to the controller 132 indicating the distance traveled by the coiled tubing string 102. Because the second feature is 200 meters from the feature, upon receiving data from the encoder 122 indicating that the coiled tubing string 102 has been displaced a desired distance (i.e., 200 meters), the controller 132 may send a control signal to the brake 112 to stop movement of the coiled tubing string 102.

By integrating the encoder 122 with the dedicated controller 132, the coiled tubing system 100 may enable more precise control of the movement of the coiled tubing string 102, thereby increasing a resolution of the coiled tubing system 100. Further, because the dedicated brake system 130 is positioned proximate the injector head 106 (e.g., mounted on the injector head 106, positioned less than the threshold distance 131 from the injector head 106, which is less than the threshold distance 115 from the control cabin 116 to the injector head 106), the control signal may travel shorter distances along the control line 138 relative to the distance traveled along the control line 118, thereby reducing latencies and/or delays associated with communication of a control signal to the injector head 106. For example, because the distance 131 between the dedicated brake system 130 and the injector head 106 is less than the distance 115 between the control cabin 116 and the injector head 106, a control signal communicated along the control line 138 may experience fewer forces (e.g., frictional forces, bends, turns, valves) that impede the movement of the control signal to the injector head 106 relative to a control signal communicated along the control line 118. In this way, delays and/or latencies associated with the communication of the control signal to the injector head 106 may be reduced, thereby increasing a resolution of the coiled tubing system 100 and/or enabling more precise control (e.g., granular control) of the movement of the coiled tubing string 102, and thus, the downhole tool 200.

Once the control signal is communicated to the brake 112 (e.g., from the control cabin 116, from the dedicated controller 132), the brake 112 may be configured to discharge hydraulic fluid disposed therein along a drain line, thereby enabling the brake 112 return to the resting state (e.g., disengaged state). As noted above, traditional systems may be associated with latencies and/or delays as a result of the discharge of the hydraulic fluid from the brake 112. For example, traditional systems may drain the hydraulic fluid from the brake 112 toward a case drain that is fluidly coupled to a number of other components of the coiled tubing system. In certain embodiments, traditional case drains may be located proximate the control cabin 116 (e.g., located at least the threshold distance 115 from the injector head 106) such that hydraulic fluid discharged out of the brake 112 must travel the threshold distance 115 before the brake 112 transitions to the resting state to engage the motor 110. Further, because traditional case drains are fluidly coupled to a number of other components, a pressure within the case drain may fluctuate depending on the operating conditions of the coiled tubing system. In certain embodiments, the fluctuations in pressure may cause hydraulic fluid discharged from the brake system to drain (e.g., bleed off) in an undesirable and/or unpredictable manner. For example, if the pressure in the case drain is above a threshold value, a pressure differential between the brake 112 and the case drain may be insufficient to drive the hydraulic fluid out of the brake system within a threshold amount of time.

To this end, the dedicated brake system 130 may include a dedicated case drain 140 fluidly coupled to the brake 112 via a discharge line 142. The dedicated case drain 140 may correspond to a receiver volume configured to receive the hydraulic fluid from the brake 112. In certain embodiments, the dedicated case drain 140 may be mounted and/or coupled to the injector head 106 and/or may be positioned less than the threshold distance 131 from the injector head 106. Similar to the discussion above with respect to the communication of the control signal, because the dedicated case drain 140 is positioned proximate the injector head 106 (e.g., mounted on the injector head 106, positioned less than the threshold distance 131 from the injector head 106, which is less than the threshold distance 115 from the control cabin 116 to the injector head 106), the hydraulic fluid discharged out of the brake 112 may travel shorter distances along the discharge line 142 relative to traditional coiled tubing systems having a case drain positioned proximate the control cabin 116. Additionally, the dedicated case drain 140 may not be coupled to other components of the coiled tubing system 100, thereby reducing pressure fluctuations within the dedicated case drain 140. For example, a pressure of the dedicated case drain 140 may be maintained at a particular pressure (e.g., zero psi) that provides a sufficient pressure differential between the brake 112 and the dedicated case drain 140, thereby enabling hydraulic fluid to be discharged along the discharge line 142 into the dedicated case drain 140 within a threshold amount of time (e.g., less than one second). In this way, delays and/or latencies associated with the discharge of the hydraulic fluid from the brake 112 may be reduced, thereby increasing a resolution of the coiled tubing system 100 and/or enabling more precise control (e.g., granular control) of the movement of the coiled tubing string 102, and thus, the downhole tool 200.

In the illustrated embodiment, the coiled tubing system 100 also includes a stripper assembly 144, a blowout preventer (BOP) assembly 146, and a wellhead assembly 148 positioned beneath the injector head 106 (e.g., relative to gravity). The stripper assembly 144 may be configured to provide a fluid seal around the coiled tubing string 102, thereby enabling movement of the coiled tubing string 102 along the geothermal well 14 while maintaining pressure control. The BOP assembly 146 may include a series of valves and/or other mechanical devices configured to seal the wellhead assembly 148 and/or control pressure within the geothermal well 14, thereby limiting and/or blocking blowouts (e.g., uncontrolled release of fluids from the geothermal well 14). The wellhead assembly 148 may be configured to provide an interface between the surface 16 and the geothermal well 14 that increases the structural integrity of the coiled tubing system 100.

Figure 3:
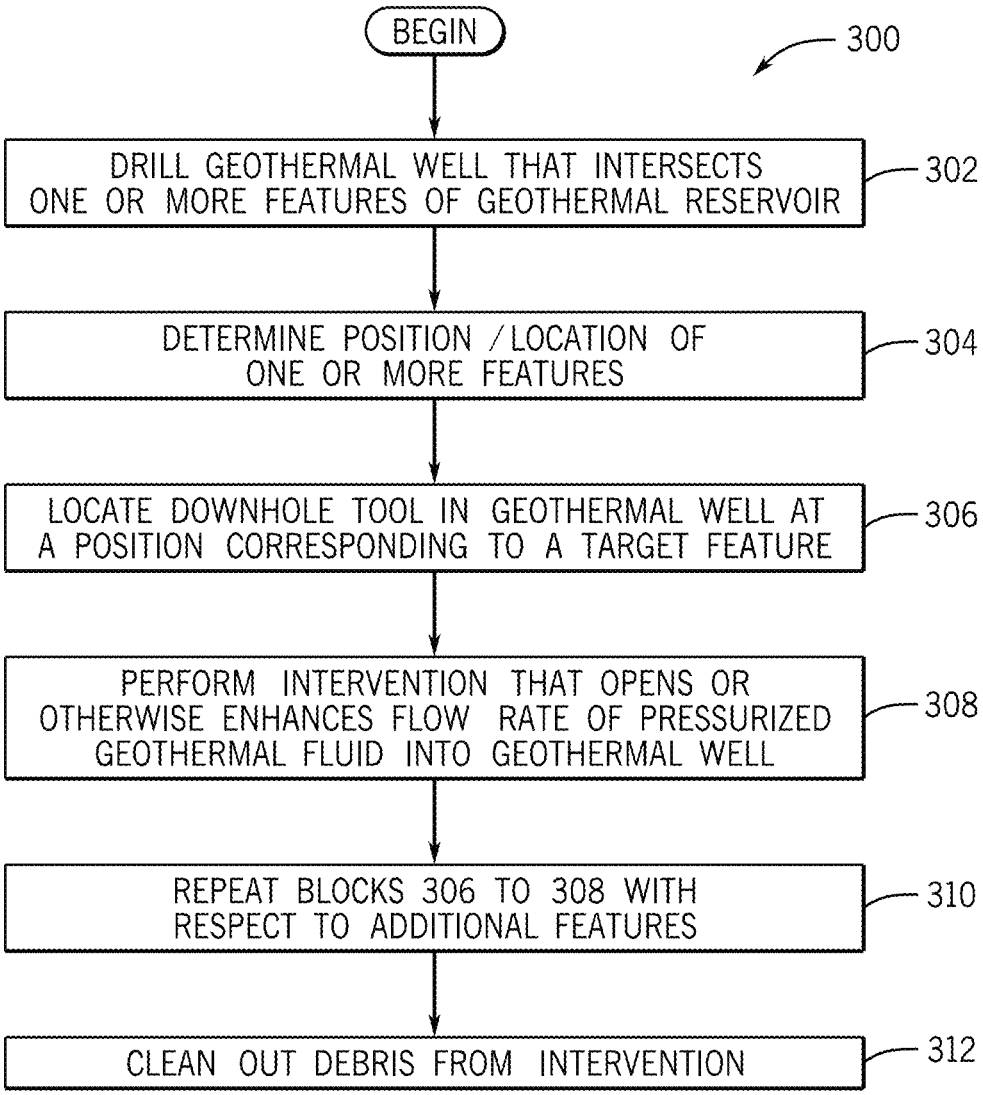
FIG. 3 is a flowchart of an embodiment of a method for extracting pressurized geothermal fluid from a geothermal reservoir, in accordance with aspects of the present disclosure.

FIG. 3 is a flowchart of an example process 300 or workflow which includes an intervention that opens a feature (e.g., features 18) that intersects a geothermal well (e.g., geothermal well 14, production well, producer well, injection well, injector well) or otherwise enhances or increases the flow rate of pressurized geothermal fluid into the geothermal well of the system (e.g., geothermal system 10). Additionally, or alternatively, the intervention may improve and/or increase a heat transfer capacity of a geothermal reservoir. In certain embodiments, certain steps of the process 300 may be performed by the coiled tubing system 100, by downhole equipment (e.g., downhole tool 200), and/or by a processor-based computing device or controller (e.g., control system 114, dedicated controller 132) or any other suitable computing device(s) or controller(s). Furthermore, the blocks of the process 300 may be performed in the order disclosed herein or in any other suitable order. For example, certain blocks of the process 300 may be performed concurrently. In addition, in certain embodiments, one or more of the blocks of the process 300 may be repeated or omitted.

In block 302, a geothermal well (e.g., geothermal well 14) is drilled such that the geothermal well intersects one or more features of a geothermal reservoir (e.g., features 18 of the geothermal reservoir 12 of FIG. 1). As noted above, the one or more features may extend through the geothermal reservoir. In certain embodiments, each of one or more of the features may be fluidly coupled to the geothermal well via an aperture (e.g., opening) of the feature that is intersected by the geothermal well. The one or more features may contain pressurized geothermal fluid (e.g., hot water, brine, steam), which may be collected by the geothermal well and delivered to the surface to be used as thermal energy. Additionally, or alternatively, the one or more features may contain a thermal fluid that is introduced into the geothermal reservoir (e.g., into the one or more features via an injector well), whereby the geothermal reservoir deposits heat to the thermal fluid, such that a thermal-energy charged fluid may be retrieved by the geothermal system (e.g., by a producer well of the geothermal system) and delivered to the surface to be used as thermal energy, as discussed above.

In block 304, well log data (e.g., subsurface data) may be analyzed (e.g., by a processor-based computing device) to determine a position of each of the one or more features intersected by the geothermal well drilled in block 302 and/or a distance between the one or more features intersected by the geothermal well. For example, borehole pressure measurements, caliper measurements, resistivity measurements, acoustic or ultrasonic borehole imaging measurements, and/or other downhole measurements may be analyzed to determine a wellbore depth (e.g., position, measured depth) for each of the one or more features. These measurements may be performed while drilling and/or by the coiled tubing system 100 after drilling, and/or by other conveyances (e.g., wireline) after drilling. For example, borehole pressure measurements may be analyzed for pressure loss while drilling. When the drilling crosses or otherwise intersects a feature, the borehole pressure will decrease. The depth of such pressure loss can be detected and used as the measured depth (e.g., position) of the feature in the geothermal well.

Additionally, or alternatively, the coiled tubing system 100 may be utilized to determine a measured depth of a feature that intersects the geothermal well. For example, after the formation of the geothermal well in block 302, a measurement tool may be run into the geothermal well via the coiled tubing system 100 to identify features that intersect the geothermal well. In certain embodiments, the measurement tool may be coupled to the end 101 of the coiled tubing string 102, and the injector head 106 may be configured to drive movement of the measurement tool along the geothermal well. In certain embodiments, the measurement tool may correspond to a casing collar locator (CCL) or a gamma ray tool configured to detect one or more reference points (e.g., casing collars, pup joints) corresponding to the one or more features and/or to directly detect the one or more features. For example, the CCL may be run on the coiled tubing string 102 to detect one or more reference points (e.g., casing collars, pup joints) within a cased on lined geothermal well, whereas the gamma ray tool may detect the one or more reference points and/or the features directly.

In certain embodiments, the measurement tool may be configured to communicate with the control system 114 and/or the dedicated control system 132 of the coiled tubing system 100 in real-time via electrical or optical telemetry cables extending through or along the coiled tubing string 102. Upon detection by the measurement tool of a reference point or feature, the reel 104 of the coiled tubing system 100 may be flagged (e.g., marked physically, marked digitally) or otherwise recorded to correlate the reel 104 of the coiled tubing system 100 with the reference point or feature. In certain embodiments, the control system 114 may correlate the one or more flagged points against other data to determine the measured depths of the reference points or the features. The control system 114 and/or the dedicated control system 132 may determine relative positions between reference points and/or features, and the control system 114 and/or the dedicated control system 132 may correlate the reference points within the accuracy tolerance 202 of the features 18. In certain embodiments, the control system 114 and/or the dedicated control system 132 may be configured to utilize real-time telemetry and communication with the measurement tool and/or other systems to determine the measured depth of a feature and/or reference point.

In certain embodiments, the measured depth may correspond to a wellbore depth of an aperture of a fracture (e.g., feature) in the geothermal well. In certain embodiments, the subsurface data may be obtained from direct measurement of the geothermal well, from surface measurements, or from offset wells. In certain embodiments, other types of data may be analyzed in block 304 to identify a location of the one or more features. For example, in certain embodiments, one or more of the features may change or adjust over time (e.g., as a result of pressurized geothermal fluid flowing out of the feature(s), based on an intervention process targeting one or more of the features). Accordingly, in certain embodiments, real-time data may be analyzed (e.g., data received from electrical and/or optical telemetry cables extending along the geothermal well) to identify the changes to a location of the one or more features. Such real-time data may be utilized by the process 300 to adjust certain operating parameters (e.g., adjust a position of a downhole tool coupled to the coiled tubing system 100), thereby increasing the efficiency of the process 300, as discussed in greater detail below.

In block 306, a downhole tool (e.g., downhole tool 200) may be located in the geothermal well at a measured depth corresponding to the position of the feature as determined in block 304. The downhole tool may be located in the geothermal well via the coiled tubing system 100. As discussed above, accurately positioning the downhole tool for the intervention at or near the intersection of the feature and the geothermal well (e.g., within the accuracy tolerance 202 of the feature) increases the effectiveness of the intervention. That is, an intervention performed within the accuracy tolerance (e.g., intervention that is performed less than three feet, less than two feet, less than one foot) of the feature that intersects the geothermal well can greatly improve the efficacy of the intervention.

In certain embodiments, the coiled tubing system 100 and/or components thereof (e.g., dedicated controller 132) may be configured to automatically control the movement of the coiled tubing string 102 (e.g., without input from an operator positioned within the control cabin 116). For example, using sensor data from the encoder 122, the dedicated controller 132 may cause the injector head 106 to displace the downhole tool coupled to the coiled tubing string a desired distance that corresponds to a measured depth of a feature that intersects the geothermal well. As noted above, in certain embodiments, the desired distance may correspond to a distance between features that intersect the geothermal well. For example, the encoder 122 may communicate data indicating that the coiled tubing string 102 has been displaced a first desired distance that corresponds to the measured depth of a first feature that intersects the geothermal well, thereby enabling the dedicated controller to engage the brake 112 to stop movement of the coiled tubing string 102. Thereafter (e.g., after performing an intervention at the first feature), the dedicated controller 132 may control operation of the injector head 106 to move the coiled tubing string 102 toward a second feature, and the encoder 122 may communicate data indicating that the coiled tubing string 102 has been displaced a second desired distance that corresponds to a difference between the measured depth of the first feature and a measured depth of a second feature.

In certain embodiments, the operator may control operation of the injector head 106 (e.g., via the control cabin 116) until the downhole tool is a threshold distance away from a target location (e.g., measured depth corresponding to a feature). That is, in certain embodiments, the operator may control movement of the coiled tubing string 102, and thus the downhole tool, for a first period of time when the downhole tool is greater than a threshold distance (e.g., greater than 100 meters) away from a feature. However, because the dedicated controller 132 may more precisely control movement of the coiled tubing string 102, once the downhole tool is less than the threshold distance from the measured depth of a feature, the dedicated controller 132 may be configured to take over the control of the movement of the coiled tubing string 102, thereby enabling consistent placement of the downhole tool within the accuracy tolerance of a feature.

In certain embodiments, the coiled tubing system 100 may utilize dynamic and/or transient models to locate the downhole tool in the geothermal well. The dynamic and/or transient modeling systems may be configured to account for various downhole factors (e.g., real-time factors, operating conditions) associated with the movement (e.g., deploying, retracting) and/or operation of a downhole tool via the coiled tubing string 102 of the coiled tubing system 100. In certain embodiments, the modeling system may be configured to predict the effects of various downhole conditions and/or operating factors on the coiled tubing string 102, thereby enabling the coiled tubing system 100 to compensate for such factors and/or conditions when locating a downhole tool within the geothermal well. For example, as the coiled tubing string 102 is moved along the wellbore, portions of the outer diameter of the coiled tubing string 102 may engage with (e.g., contact) portions of the inner diameter of the completion (e.g., casing, liner, open hole). In certain instances, contact between the coiled tubing string 102 and the completion may generate frictional forces that can cause the coiled tubing string 102 to readjust (e.g., retract, elongate) within the geothermal well. For example, as an amount of friction between the coiled tubing string 102 and the wellbore (e.g., wellbore completion) increases, a tendency for the coiled tubing string 102 to bend and/or adjust (e.g., retract) may increase. In certain instances, however, the frictional forces imparted to the coiled tubing string 102 may be overcome by a weight of the coiled tubing string 102 such that the coiled tubing string readjusts (e.g., elongates). That is, the frictional forces imparted to the coiled tubing string 102 may cause the coiled tubing string 102 to experience a first adjustment in which the coiled tubing string retracts. Thereafter, the weight of the coiled tubing string may overcome the frictional forces, thereby enabling the coiled tubing string to experience a second adjustment in which the coiled tubing string elongates. The models discussed herein may be configured to account for such bends and/or adjustments of the coiled tubing string 102 as a function of the forces imparted to the coiled tubing string 102 as the coiled tubing string 102 is moved along the geothermal well.

Additionally, or alternatively, as the coiled tubing string is operated to perform an intervention, fluid may be directed through and/or along the coiled tubing string 102 (e.g., along a backside of the coiled tubing string 102) toward a downhole tool coupled thereto. In certain embodiments, the dynamic and/or transient models discussed herein may be configured to predict adjustments to the coiled tubing string 102 (e.g., elongation, retraction) based on a type of fluid directed through and/or along the coiled tubing string 102, a rate at which the fluid is directed through and/or along the coiled tubing string 102, a metal plasticity of the coiled tubing string 102, and the like. That is, as fluid is directed through and/or along the coiled tubing string 102, the fluid may cause the coiled tubing string 102 to bend and/or adjust (e.g., retract, elongate). Further, the fluid may cause the coiled tubing string 102 (e.g., the outer diameter of the coiled tubing string) to contact and/or engage with portions of the wellbore, as discussed above. The models discussed herein may be configured to account for such adjustments as a function of the operational conditions of the coiled tubing string 102 (e.g., a type of fluid directed through and/or along the coiled tubing string 102, a rate at which the fluid is directed through and/or along the coiled tubing string 102, a metal plasticity of the coiled tubing string 102), thereby improving the placement accuracy of a downhole tool coupled to the coiled tubing string 102.

Figure 4:
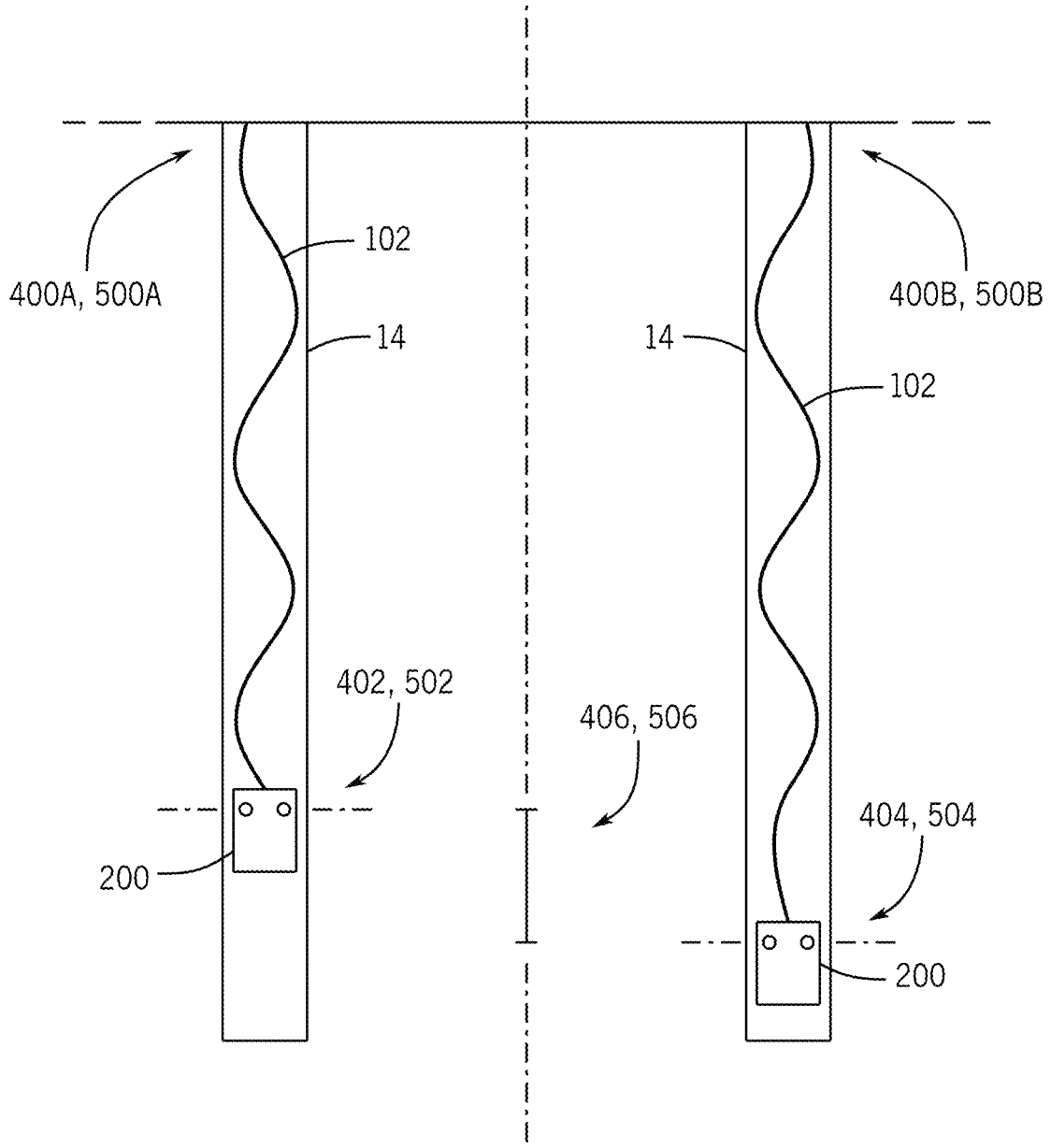
FIG. 4 is a schematic diagram of an embodiment of the positioning of a downhole tool as a function of changing downhole factors, in accordance with aspects of the present disclosure.

For example, FIG. 4 illustrates the differences between an unmodeled configuration 400A of the coiled tubing string 102 and an adjusted configuration 400B (e.g., modeled configuration) of the coiled tubing string 102 as a result of operating the coiled tubing system 100 (e.g., pumping fluid through and/or along the coiled tubing string 102 and toward the downhole tool 200 coupled to the coiled tubing system 100 to operate the downhole tool 200). In the illustrated embodiment, the downhole tool 200 (e.g., abrasive perforating gun) may align with a first position 402 along the wellbore in the unmodeled configuration 400A of the coiled tubing system 100 and may align with a second position 404 in the adjusted configuration 400B of the coiled tubing system 100. A distance 406 between the first position 402 and the second position 404 may correspond to a difference in the positioning of the downhole tool 200 when operational conditions are not accounted for (e.g., as shown in unmodeled configuration 400A) and when operational conditions are accounted for (e.g., as shown in adjusted configuration 400B).

It should be appreciated that while the distance 406 is described above as corresponding to the difference in the positioning of the downhole tool based on whether operational conditions are accounted for (e.g., whether fluid flow and/or flow rate through the coiled tubing string 102 are accounted for), in other embodiments, the distance 406 may correspond to the difference in the positioning of the downhole tool based on whether changing normal forces against completion are accounted for (e.g., whether frictional forces imparted to the coiled tubing string as the downhole tool is moved along the geothermal well are accounted for). For example, in certain embodiments, the unmodeled configuration 400A may correspond to a modeled configuration 500A and the modeled configuration 400B may correspond to an unmodeled configuration 500B. In such embodiments, the downhole tool 200 may align with a first position 502 along the wellbore in the modeled configuration 500A and may align with a second position 504 in the unmodeled configuration 500B. The distance 506 between the first position 502 and the second position 504 may correspond to the difference in the positioning of the downhole tool when frictional forces are accounted for (as shown in the retracted configuration 500A) and when frictional forces are not accounted for (as shown in the elongated configuration 500B).

The coiled tubing system 100 (e.g., the dedicated controller 132) may determine the distances 406, 506 by monitoring the adjustment and/or elongation of the coiled tubing string 102 as the coiled tubing system 100 deploys and/or operates the downhole tool 200, thereby improving the placement accuracy of the downhole tool relative to a feature intersecting the well. Returning to FIG. 3, in block 306, the coiled tubing system 100 (e.g., the dedicated controller 132) may be configured to adjust the coiled tubing string depth based on the distance 406 or the distance 506, thereby accounting for the various dynamic and/or transient downhole conditions. As an example, the dedicated controller 132 may determine, based on the models, that when the downhole tool is deployed to a measured depth of 1500 meters, and when fluid is directed through the coiled tubing string at a particular rate to operate the downhole tool, the coiled tubing string 102 may elongate by 5 meters within the geothermal well (e.g., as a result of the fluid being directed therethrough). Accordingly, when deploying the downhole tool, the dedicated controller 132 may be configured to account for the elongation such that the dedicated controller 132 moves the downhole tool a target distance of 1495 meters, thereby enabling the downhole tool to reach the measured depth of 1500 meters corresponding to the feature once fluid is directed through the coiled tubing string 102.

As another example, the dedicated controller 132 may determine, based on the models, that when the downhole tool is deployed to a measured depth of 1500 meters, the coiled tubing string 102 may bend or retract 5 meters (e.g., as a result of the frictional forces generated as the coiled tubing string 102 moves along the wellbore). Accordingly, when deploying the downhole tool, the dedicated controller 132 may be configured to account for the retraction such that the dedicated controller 132 moves the downhole tool a target distance of 1505 meters, thereby enabling the downhole tool to reach the measured depth of 1500 meters corresponding to the feature. It should be appreciated that while the discussion above describes the dedicated controller 132 as performing the above functions, in certain embodiments, the operator may control the operation of the injector head 106 via the control cabin 116, and may use the models described above to account for transient and/or dynamic downhole conditions. In this way, the placement accuracy of the downhole tool coupled to the coiled tubing string may be increased, thereby improving the efficiency and/or efficacy of an intervention performed by the downhole tool.

In addition to accounting for the distance 406 or the distance 506 discussed above, it should be appreciated that the coiled tubing system 100 discussed herein may also enable increased resolution of interventions performed by a downhole tool coupled to the coiled tubing system. For example, an operator may be tasked with locating the downhole tool within a threshold distance (e.g., five meters) of a feature that intersects the geothermal well. Thereafter, the encoder 122 may be configured to communicate with the dedicated brake system 130 to granularly move the coiled tubing string 102 until the coiled tubing string 102 has been displaced by a desired distance. That is, because the encoder 122 is configured to monitor granular movement of the coiled tubing string 102, the encoder 122 (and the dedicated brake system 130 having the dedicated controller 132 communicatively coupled to the encoder 122) may be better suited to control movement of the downhole tool and/or coiled tubing string once the coiled tubing string is within a threshold distance of a feature. In this way, the dedicated controller 132 may move the coiled tubing string 102 until the coiled tubing string 102 travels the desired distance (e.g., reaches the desired depth), thereby enabling the dedicated brake system 130 to automatically engage the brake based on a determination that the coiled tubing string 102 has traveled the desired distance.

In block 308, the downhole tool can be operated to perform an intervention that selectively opens one or more of the features (e.g., increases the permeability of the one or more features) or otherwise enhances and/or increases the flow rate of pressurized geothermal fluid from the geothermal reservoir into the geothermal well. Additionally, or alternatively, the intervention may increase and/or enhance a heat transfer capacity of the geothermal reservoir. For example, the intervention may include perforating at a position in the geothermal well that corresponds to the position of a feature intersecting the geothermal well (e.g., using abrasive perforating guns [APGs]), stimulating at a position in the geothermal well that corresponds to the position of a feature intersecting the geothermal well (e.g., acidizing, injecting frac fluid), cutting or enlarging the feature, or any combination thereof. In certain embodiments, the intervention can extend through an aperture of a feature into a near wellbore region of the geothermal well with a limited radial length in the range of two feet to fifty feet into the near wellbore region. In certain embodiments, the intervention can be localized with respect to the aperture of the feature by setting packers (e.g., inflatable packers, isolation packers, straddle packers) at measured depth in the geothermal well above and below the aperture of the feature. In certain embodiments, the intervention can extend about the circumference of the geothermal well.

In certain embodiments, the coiled tubing system 100 may employ the models discussed above to account for various operating conditions of the downhole tool employed to perform the intervention. For example, as noted above, in certain embodiments, abrasive perforated guns (APGs) may be used to perforate and/or stimulate a feature. The APGs may include nozzles configured to inject and/or introduce a treatment fluid (e.g., slurry, proppant slurry) into the features to stimulate, open, and/or otherwise enhance the features (e.g., increase a permeability of the features), thereby increasing a flow rate of pressurized geothermal fluid from the features into the geothermal well. During operation of the APGs, the nozzles may erode and/or degrade based on various downhole and/or operating conditions. For example, the type of fluid directed through the nozzles and/or the rate at which fluid is directed through the nozzles to perforate and/or stimulate a feature may impact a rate of degradation of the nozzles.

Accordingly, in block 308, the coiled tubing system 100 may be configured to receive real-time data from electrical and/or optical telemetry cables extending along the geothermal well, where the real-time data is indicative of the operating conditions of the downhole tool, thereby enabling the coiled tubing system 100 to adjust the operating parameters of the downhole tool in block 308. For example, based on data indicating that an APG (e.g., nozzle of an APG) is approaching a degradation threshold, the coiled tubing system 100 may adjust (e.g., increase) the flow rate of treatment fluid through the nozzle, thereby improving the efficiency and/or efficacy of an intervention performed by the downhole tool.

In optional block 310, the operations of blocks 306 and 308 may be repeated with respect to additional feature(s) that intersect the geothermal well in order to increase the flow rate of pressurized geothermal fluid into the geothermal well. In optional block 312, debris resulting from the intervention of block 308 may be cleaned out and/or removed from the geothermal well (e.g., via the coiled tubing system 100), thereby further increasing the flow rate of pressurized geothermal fluid into the geothermal well.

Technical effects of the present disclosure include an improved coiled tubing system that provides increased resolution for locating a downhole tool within a geothermal well while accounting for various downhole and/or operating conditions, thereby increasing placement of a downhole tool at the intersection of a feature and the geothermal well. For example, the coiled tubing system discussed herein includes a dedicated brake system configured to communicate with an encoder of the coiled tubing system to granularly control movement of a coiled tubing string of the coiled tubing system. The dedicated brake system may be positioned less than a threshold distance from an injector head that drives movement of the coiled tubing string, thereby reducing delays and/or latencies associated with the communication of a control signal (e.g., brake signal) configured to cause a brake to engage a motor of the coiled tubing system to stop movement of the coiled tubing system. Moreover, the dedicated brake system may include a dedicated case drain configured to receive hydraulic brake fluid from the brake once the brake receives the control signal. The dedicated case drain may also be positioned less than a threshold distance away from the brake, and the dedicated case drain may not be coupled to other components of the coiled tubing system such that a pressure within the dedicated case drain is maintained at a desired pressure. By positioning the dedicated case drain less than the threshold distance from the brake and by maintaining a desired pressure within the case drain, additional delays and/or latencies associated with the draining of the hydraulic fluid from the brake may also be reduced, thereby increasing a resolution of the coiled tubing system. Further still, embodiments discussed herein may employ transient and/or dynamic modeling systems that take into account various downhole factors and/or conditions. In this way, adjustments of the coiled tubing string as a function of changing forces during movement of the coiled tubing string and/or adjustments of the coiled tubing string as a function of changing operating conditions of the coiled tubing string may be accounted for, thereby further increasing placement accuracy of a downhole tool coupled to the coiled tubing string.

The subject matter described in detail above may be defined by one or more clauses, as set forth below.

A coiled tubing system includes a coiled tubing string configured to couple to a downhole tool to move the downhole tool along a geothermal well, an injector head configured to control movement of the coiled tubing string and the downhole tool along the geothermal well, one or more sensors configured to capture sensor data indicative of a distance traveled by the coiled tubing string along the geothermal well, and a controller configured to control operation of the injector head to move the coiled tubing string and the downhole tool to a measured depth within the geothermal well that corresponds to an intersection of a feature with the geothermal well based on the sensor data received from the one or more sensors.

The coiled tubing system of the preceding clause, wherein the injector head includes one or more chains configured to engage the coiled tubing string to move the coiled tubing string, a motor coupled to the one or more chains to drive operation of the one or more chains, and a brake configured to engage the motor to stop the movement of the coiled tubing string along the geothermal well.

The coiled tubing system of any preceding clause, wherein controlling operation of the injector head includes operating, via the controller, the motor to drive the one or more chains to bias the coiled tubing string and the downhole tool toward the measured depth, and sending a control signal, via the controller, to the brake to cause the brake to engage the motor to stop the movement of the coiled tubing string based on the distance traveled by the coiled tubing string corresponding to the measured depth.

The coiled tubing system of any preceding clause, wherein controlling operation of the injector head includes after sending the control signal to the brake to cause the brake to engage the motor, operating, via the controller, the motor to drive the one or more chains to bias the coiled tubing string and the downhole tool toward a second measured depth that corresponds to a second intersection of a second feature with the geothermal well, wherein the measured depth and the second measured depth are separated by a particular distance, and sending an additional control signal, via the controller, to the brake to cause the brake to engage the motor to stop the movement of the coiled tubing string based on the distance traveled by the coiled tubing string corresponding to the particular distance.

The coiled tubing system of any preceding clause, wherein the controller is positioned less than a threshold distance away from the injector head such that the control signal from the controller to the brake travels less than the threshold distance to cause the brake to engage the motor.

The coiled tubing system of any preceding clause, wherein the threshold distance is five meters.

The coiled tubing system of any preceding clause, wherein the control signal causes the brake to engage the motor in less than a threshold amount of time.

The coiled tubing system of any preceding clause, wherein the brake is configured to discharge hydraulic fluid in response to receiving the control signal from the controller to cause the brake to engage the motor, and wherein the coiled tubing system includes a case drain configured to receive the hydraulic fluid from the brake.

The coiled tubing system of any preceding clause, wherein the case drain is not coupled to other components of the coiled tubing system.

The coiled tubing system of any preceding clause, wherein the case drain is positioned less than a threshold distance away from the injector head.

The coiled tubing system of any preceding clause, wherein the case drain is mounted to the injector head.

A dedicated brake system for a coiled tubing system includes an injector head configured to control movement of a coiled tubing string of the coiled tubing system along a geothermal well, wherein the injector head includes one or more chains configured to grip the coiled tubing string to move the coiled tubing string, a motor coupled to the one or more chains and configured to bias the one or more chains in a particular direction to move the coiled tubing string in the particular direction, a brake configured to engage the motor to stop the movement of the coiled tubing string, and one or more sensors configured to monitor a distance traveled by the coiled tubing string. The dedicated brake system further includes a controller configured to control operation of the injector head by receiving sensor data from the one or more sensors indicative of the distance traveled by the coiled tubing string, causing the motor to bias the one or more chains in the particular direction toward a measured depth corresponding to an intersection of a feature with the geothermal well, and causing the brake to engage the motor to stop the movement of the coiled tubing string in response to determining that the distance traveled corresponds to the measured depth.

The dedicated brake system of the preceding clause, wherein causing the brake to engage the motor to stop the movement of the coiled tubing string includes sending, via the controller, a control signal to the brake.

The dedicated brake system of any preceding clause, wherein the control signal corresponds to a hydraulic signal communicated over a control line, wherein the control line extends between the dedicated brake system and the brake for less than a threshold distance.

The dedicated brake system of any preceding clause, including a dedicated case drain configured to receive hydraulic fluid from the brake in response to the brake engaging with the motor, wherein the dedicated case drain is coupled to the injector head such that the dedicated case drain is positioned less than a threshold distance from the brake.

The dedicated brake system of any preceding clause, wherein the dedicated case drain is not coupled to other components of the coiled tubing system such that a pressure within the dedicated case drain is maintained below a threshold pressure level.

A method for locating a downhole tool in a geothermal well using a coiled tubing system includes analyzing subsurface data to determine respective locations of a plurality of features that intersect the geothermal well, operating, via a controller, an injector head of the coiled tubing system to deploy the downhole tool toward a first location of a first feature of the plurality of features, wherein the first location includes a measured depth along the geothermal well, receiving, via one or more sensors, sensor data indicative of a distance traveled by a coiled tubing string of the coiled tubing system coupled to the downhole tool, determining, via the controller, that the distance traveled by the coiled tubing string corresponds to the measured depth based on the sensor data, and causing, via the controller, the injector head to stop movement of the coiled tubing string in response to determining that the distance traveled by the coiled tubing string corresponds to the measured depth of the first feature.

The method of the preceding clause, including operating, via the controller, the injector head using one or more dynamic models configured to account for one or more dynamic downhole conditions.

The method of any preceding clause, wherein the dynamic downhole conditions include a flow rate of fluid directed through the coiled tubing string, wherein the flow rate of fluid directed through or along the coiled tubing string causes the coiled tubing string to elongate by a particular distance within the geothermal well, and wherein the method includes causing, via the controller, the injector head to stop movement of the coiled tubing string in response to determining that a sum of the distance traveled and the particular distance corresponds to the measured depth of the first feature.

The method of any preceding clause, wherein the downhole tool includes an abrasive perforated gun (APG) having one or more nozzles, wherein the dynamic downhole conditions include a rate of degradation of the one or more nozzles, and wherein the method includes operating the one or more nozzles to inject a fluid at a first flow rate into the first feature, determining that the rate of degradation exceeds a degradation threshold, and operating the one or more nozzles to inject the fluid at a second flow rate that is greater than the first flow rate based on the rate of degradation of the one or more nozzles exceeding the degradation threshold The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrated and described may be re-arranged, and/or two or more elements may occur simultaneously. The embodiments were chosen and described in order to best explain the principals of the disclosure and its practical applications, to thereby enable others skilled in the art to best utilize the disclosure and various embodiments with various modifications as are suited to the particular use contemplated.

Finally, the techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A coiled tubing system, comprising:

a coiled tubing string configured to couple to a downhole tool to move the downhole tool along a geothermal well;

an injector head configured to control movement of the coiled tubing string and the downhole tool along the geothermal well, wherein the injector head comprises:

one or more chains configured to engage the coiled tubing string to move the coiled tubing string;

a motor coupled to the one or more chains to drive operation of the one or more chains; and a brake configured to engage the motor to stop the movement of the coiled tubing string along the geothermal well;

one or more sensors configured to capture sensor data indicative of a distance traveled by the coiled tubing string along the geothermal well; and a controller configured to control operation of the injector head to move the coiled tubing string and the downhole tool to a measured depth within the geothermal well that corresponds to an intersection of a feature with the geothermal well based on the sensor data received from the one or more sensors.

2. The coiled tubing system of claim 1, wherein controlling operation of the injector head comprises:

operating, via the controller, the motor to drive the one or more chains to bias the coiled tubing string and the downhole tool toward the measured depth; and sending a control signal, via the controller, to the brake to cause the brake to engage the motor to stop the movement of the coiled tubing string based on the distance traveled by the coiled tubing string corresponding to the measured depth.

3. The coiled tubing system of claim 2, wherein controlling operation of the injector head comprises:

after sending the control signal to the brake to cause the brake to engage the motor, operating, via the controller, the motor to drive the one or more chains to bias the coiled tubing string and the downhole tool toward a second measured depth that corresponds to a second intersection of a second feature with the geothermal well, wherein the measured depth and the second measured depth are separated by a particular distance; and sending an additional control signal, via the controller, to the brake to cause the brake to engage the motor to stop the movement of the coiled tubing string based on the distance traveled by the coiled tubing string corresponding to the particular distance.

4. The coiled tubing system of claim 2, wherein the controller is positioned less than a threshold distance away from the injector head such that the control signal from the controller to the brake travels less than the threshold distance to cause the brake to engage the motor.

5. The coiled tubing system of claim 4, wherein the threshold distance is five meters.

6. The coiled tubing system of claim 4, wherein the control signal causes the brake to engage the motor in less than a threshold amount of time.

7. The coiled tubing system of claim 2, wherein the brake is configured to discharge hydraulic fluid in response to receiving the control signal from the controller to cause the brake to engage the motor, and wherein the coiled tubing system comprises a case drain configured to receive the hydraulic fluid from the brake.

8. The coiled tubing system of claim 7, wherein the case drain is not coupled to other components of the coiled tubing system.

9. The coiled tubing system of claim 7, wherein the case drain is positioned less than a threshold distance away from the injector head.

10. The coiled tubing system of claim 7, wherein the case drain is mounted to the injector head.

11. A method for locating a downhole tool in a geothermal well using a coiled tubing system, the method comprising:

analyzing subsurface data to determine respective locations of a plurality of features that intersect the geothermal well;

operating, via a controller, an injector head of the coiled tubing system to deploy the downhole tool toward a first location of a first feature of the plurality of features, wherein the first location comprises a measured depth along the geothermal well;

operating, via the controller, the injector head using one or more dynamic models configured to account for one or more dynamic downhole conditions;

receiving, via one or more sensors, sensor data indicative of a distance traveled by a coiled tubing string of the coiled tubing system coupled to the downhole tool;

determining, via the controller, that the distance traveled by the coiled tubing string corresponds to the measured depth based on the sensor data; and causing, via the controller, the injector head to stop movement of the coiled tubing string in response to determining that the distance traveled by the coiled tubing string corresponds to the measured depth of the first feature.

12. The method of claim 11, wherein the dynamic downhole conditions comprise a flow rate of fluid directed through the coiled tubing string, wherein the flow rate of fluid directed through or along the coiled tubing string causes the coiled tubing string to elongate by a particular distance within the geothermal well, and wherein the method comprises causing, via the controller, the injector head to stop movement of the coiled tubing string in response to determining that a sum of the distance traveled and the particular distance corresponds to the measured depth of the first feature.

13. The method of claim 11, wherein the downhole tool comprises an abrasive perforated gun (APG) having one or more nozzles, wherein the dynamic downhole conditions comprise a rate of degradation of the one or more nozzles, and wherein the method comprises:

operating the one or more nozzles to inject a fluid at a first flow rate into the first feature;

determining that the rate of degradation exceeds a degradation threshold; and operating the one or more nozzles to inject the fluid at a second flow rate that is greater than the first flow rate based on the rate of degradation of the one or more nozzles exceeding the degradation threshold.

* * * * *